US010914143B2

(12) United States Patent
Harive et al.

(10) Patent No.: US 10,914,143 B2
(45) Date of Patent: Feb. 9, 2021

(54) PERFORATING GUN SYSTEM AND METHOD

(71) Applicant: Halliburton Energy Services, Inc., Houston, TX (US)

(72) Inventors: Kevin S. Harive, Houston, TX (US); Christopher M. Heering, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/546,876

(22) PCT Filed: Mar. 26, 2015

(86) PCT No.: PCT/US2015/022826

§ 371 (c)(1),
(2) Date: Jul. 27, 2017

(87) PCT Pub. No.: WO2016/153526

PCT Pub. Date: Sep. 29, 2016

(65) Prior Publication Data

US 2018/0016878 A1 Jan. 18, 2018

(51) Int. Cl.
*E21B 43/117* (2006.01)
*E21B 43/119* (2006.01)
(Continued)

(52) U.S. Cl.
CPC ..... *E21B 43/117* (2013.01); *E21B 33/12* (2013.01); *E21B 43/1195* (2013.01)

(58) Field of Classification Search
CPC .... E21B 43/117; E21B 43/1195; E21B 33/12; E21B 37/08; E21B 7/007; F42B 12/10
See application file for complete search history.

(56) References Cited

U.S. PATENT DOCUMENTS 3,856,094 A * 12/1974 Davis ..... E21B 43/116 175/4.52
5,133,624 A * 7/1992 Cahill ..... B09B 1/008 166/308.1
(Continued)

OTHER PUBLICATIONS

International Search Report and The Written Opinion of the International Search Authority, or the Declaration, dated Dec. 1, 2015, PCT/US2015/022826, 11 pages, ISA/KR.

*Primary Examiner* — D. Andrews
*Assistant Examiner* — Manuel C Portocarrero

(57) ABSTRACT

A single-trip method and system for perforating casing allows displacement of a heavier completion fluid from the perforation zone by a lighter formation-compatible treatment fluid without the need for an extended rat hole or repositioning the working string. The perforating system includes bridge subs located above and below a perforating gun. The bridge subs bypass treatment fluid around the gun through one or more conduits located along the exterior of the gun into a discharge flow port located immediately below the lower bridge sub. The system may be hydrodynamically designed to maintain efficient fluid displacement characteristics of the discharge flow port. The external conduits are positioned to not interfere with perforation operations and may include parallel conjoined tubes. The perforating system may be lowered to a perforation position in the wellbore, and treatment fluid pumped through the discharge flow port to displace completion fluid prior to perforation operations.

19 Claims, 4 Drawing Sheets

(51) Int. Cl.

| | |
|---|---|
| ***E21B 33/12*** | (2006.01) |
| ***E21B 37/08*** | (2006.01) |
| ***E21B 43/11*** | (2006.01) |
| ***E21B 43/116*** | (2006.01) |
| ***F42B 12/10*** | (2006.01) |

(56) References Cited

U.S. PATENT DOCUMENTS

| | | | |
|---|---|---|---|
| 5,582,250 | A | 12/1996 | Constien |
| 2007/0079960 | A1 | 4/2007 | Grove et al. |
| 2009/0139766 | A1 | 6/2009 | Samuel et al. |
| 2010/0236781 | A1 | 9/2010 | Mytopher et al. |
| 2011/0155375 | A1 | 6/2011 | Griffith |

* cited by examiner

PERFORATING GUN SYSTEM AND METHOD

PRIORITY

The present application is a U.S. National Stage patent application of International Patent Application No. PCT/US2015/022826, filed on Mar. 26, 2015, the benefit of which is claimed and the disclosure of which is incorporated herein by reference in its entirety.

TECHNICAL FIELD

The present disclosure relates generally to oilfield equipment, and in particular to downhole tools, drilling and related systems and techniques for drilling, completing, servicing, and evaluating wellbores in the earth. More particularly still, the present disclosure relates to an improvement in systems and methods for performing perforating operations in a single trip.

BACKGROUND

Formation damage may include impairment of the reservoir caused by wellbore fluids used during drilling/completion and workover operations. Formation damage may produce a zone of reduced permeability within the vicinity of the wellbore (skin) as a result of foreign fluid invasion into the reservoir rock, therefore resulting in reduced production.

In particular, formation damage may occur during casing perforation operations. After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement, and a short distance into the formation.

Typically, these perforations are created by detonating a series of shaped charges that are disposed within hollow steel carriers and positioned within the casing string adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coiled tubing, or other conveyance. Once the perforating guns are properly positioned in the wellbore such that the shaped charges are adjacent to the formation to be perforated, the shaped charges may be detonated, thereby creating the desired hydraulic openings.

The perforating operation may be conducted in an overbalanced pressure condition, wherein the pressure in the wellbore proximate the perforating interval is greater than the pressure in the formation, or in an underbalanced pressure condition, wherein the pressure in the wellbore proximate the perforating interval is less than the pressure in the formation. When perforating occurs in an underbalanced pressure condition, formation fluids tend to flow into the wellbore shortly after the casing is perforated. This inflow may be beneficial as perforating generates debris from the perforating guns, the casing and the cement that may otherwise remain in the perforation tunnels and impair the productivity of the formation.

As clean perforations are essential to a good perforating job, perforating in an underbalanced condition is preferred. It has been found, however, that due to safety concerns, maintaining an overbalanced pressure condition during most well completion operations is preferred. For example, if the perforating guns were to malfunction and prematurely initiate creating communication paths to a formation, the overbalanced pressure condition will help to prevent any uncontrolled fluid flow to the surface.

To overcome the safety concerns but still obtain the benefits associated with underbalanced perforating, efforts have been made to create a dynamic underbalance condition in the wellbore immediately following charge detonation. The dynamic underbalance is a transient pressure condition in the wellbore during the perforating operation that allows the wellbore to be maintained at an overbalanced pressure condition prior to perforating.

However, regardless of whether perforation operations are conducted in overbalanced or underbalanced conditions, formation damage may still occur due to initial fluid ingress into the formation by high pressure transients created during detonation of the shaped charges. Certain operational techniques may be used to minimize formation damage, among them displacing weighted completion fluid with lower density formation-compatible treatment fluid in front of the zone of interest prior to perforating.

The discharge flow port for introducing treatment fluid into the wellbore must be located below the perforating zone in order to displace the treatment fluid. The flow rate of the treatment fluid must be carefully controlled, because when displacing a heavy fluid by a lighter fluid, a channeling effect may occur if the flow rate is too high, resulting in incomplete displacement.

Treatment fluids may be placed at the zone of interest by running a tubing string such that a discharge flow port carried at the distal end of the tubing string is located downhole of the zone of interest and then pumping the displacing treatment fluid to the desired height. This technique requires a trip into and out of the well with the treatment fluid displacement system before running the perforating gun system. Alternatively, treatment fluid may be pumped through the perforating string to a flow port located above the perforating gun assembly. The perforating string is first lowered so that the treatment fluid flow port is located below the zone of interest to be perforated, treatment fluid is pumped into the wellbore, and then the perforating string is raised to position the perforating gun at the zone of interest. This technique may necessitate a longer rat hole to accommodate the perforating string flow port past the zone of interest and also presents running risks and concomitant costs.

BRIEF DESCRIPTION OF THE DRAWINGS

Embodiments are described in detail hereinafter with reference to the accompanying figures, in which.

DETAILED DESCRIPTION

Figure 1:
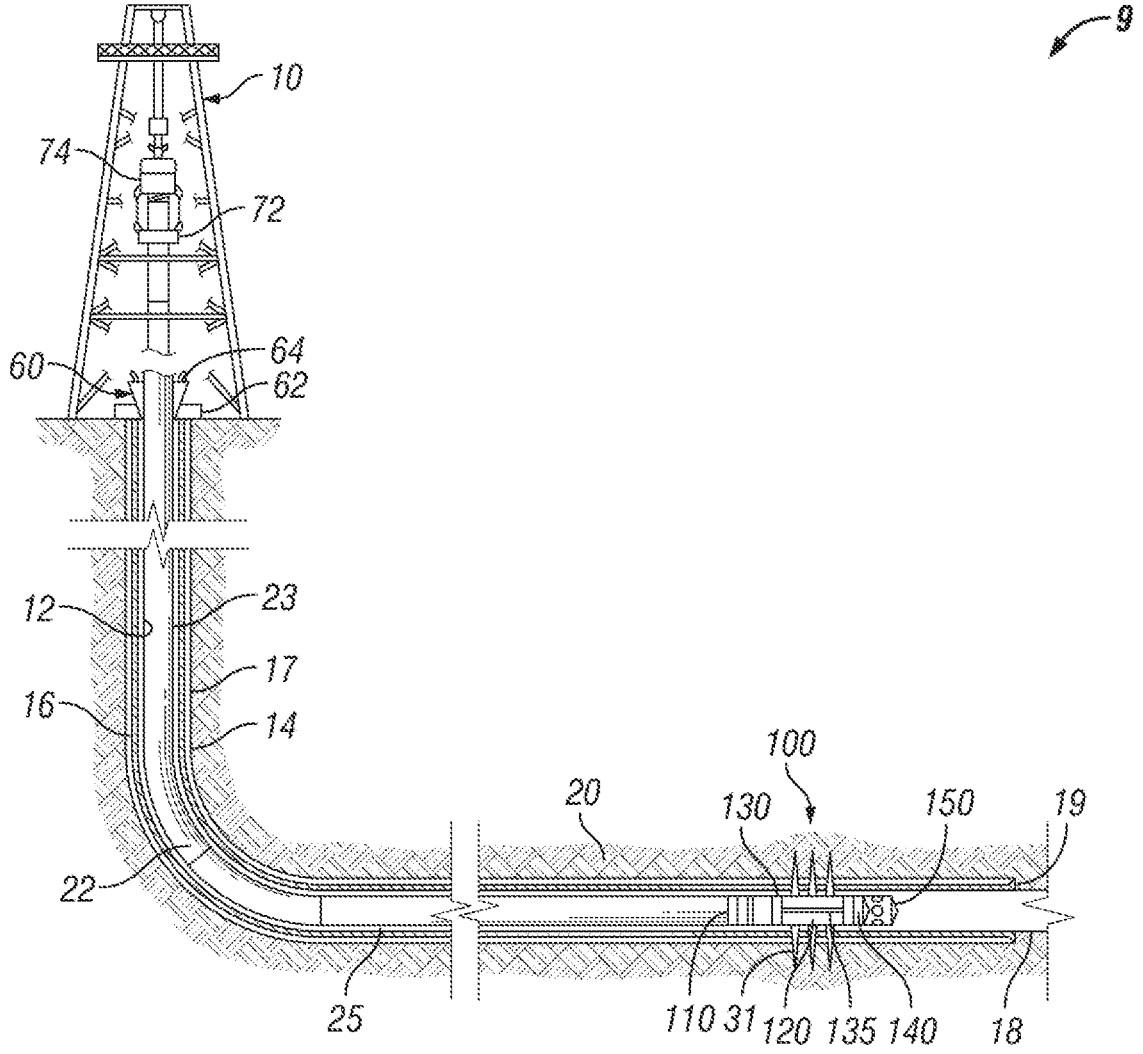
FIG. 1 is an elevation view in partial cross section of a well with a perforation system therein that employs a working string carrying a packer, a perforating gun, upper and lower bridge subs fluidly coupled by exterior conduits, and a discharge flow port downhole of the perforating gun, according to an embodiment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 is an elevation view in partial cross-section of a well system, generally designated 9, according to an embodiment. Well system 9 may include drilling, completion, servicing, or workover rig 10. Rig 10 may be deployed on land or used in association with offshore platforms, semi-submersibles, drill ships and any other system satisfactory for completing a wellbore. Completion operations may include gravel packing, fracturing, acidizing, cementing, and perforating, for example, as well as running and hanging a completion string from wellbore casing. A blow out preventer, christmas tree, and/or and other equipment associated with servicing or completing a wellbore (not illustrated) may also be provided.

Rig 10 may include suspension member 60. In an embodiment, suspension member 60 may include a rotary table 62 having a slip bowl formed therein and a set of slips 64. Rig 10 may also include an elevator 72, swivel 74, and/or top drive (not illustrated). Elevator 72 may be suspended from swivel 74. Suspension member 60, elevator 72, and swivel 74 may be used for assembling and running a working string 22, as described hereinafter.

In the illustrated embodiment, a wellbore 12 extends through various earth strata into first hydrocarbon bearing subterranean formation 20. A portion of wellbore 12 may be lined with a casing string 16, which may be joined to the formation with casing cement 17. A portion 18 of wellbore 12 may also be open hole, i.e., uncased. Casing 16 may terminate at its distal end with a casing shoe 19.

In some embodiments, working string 22, extending from the surface, may be positioned within wellbore 12. The term working string, as used herein broadly encompasses any conveyance for downhole use, including drill strings, completion strings, evaluation strings, other tubular members, wireline systems, and the like. Working string 22 may provide an internal flow path 23 for workover operations and the like as appropriate. An annulus 25 may be formed between the exterior of working string 22 and the inside wall of wellbore 12 or casing string 16.

Additionally, according to one or more embodiments, working string 22 may carry a perforation system 100, which may include a packer 110, a perforating gun 120, upper and lower bridge subs 130, 140, and a discharge flow port 150. Perforating gun 120 may be designed and arranged to creating openings 31 through casing 16, casing cement 17, and into surrounding formation 20 for fluid communication between formation 20 and the interior of casing 16.

Figure 2:
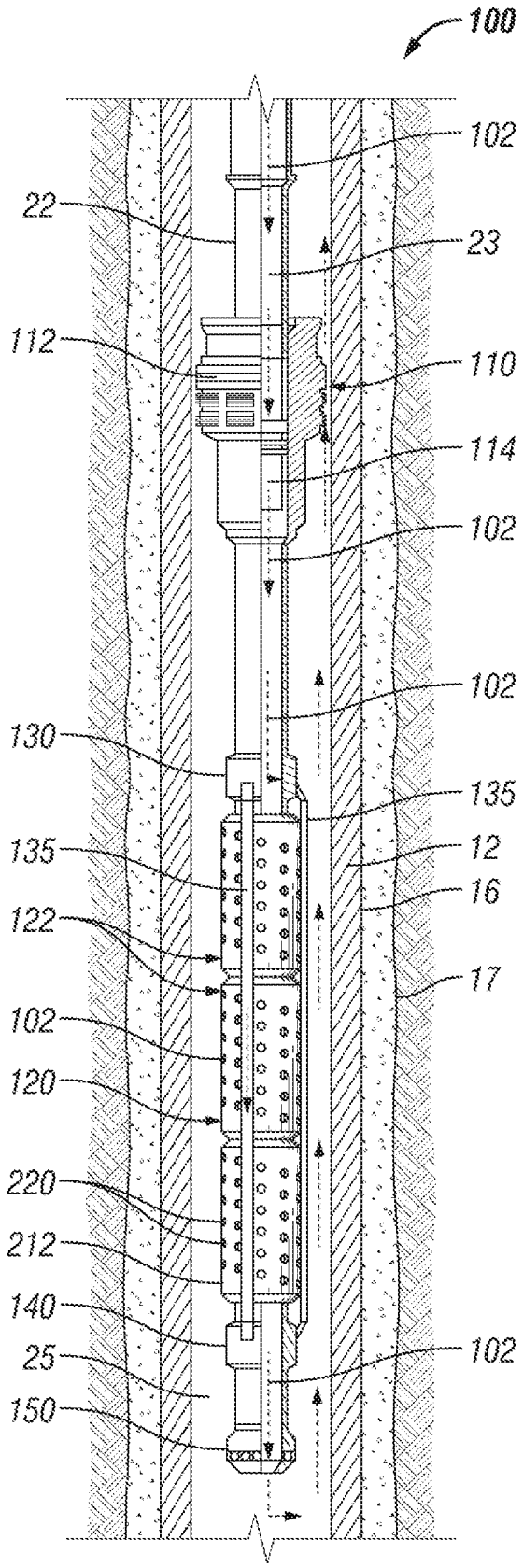
FIG. 2 is an enlarged elevation view in partial cross section of the perforation system of FIG. 1, shown with a portion of the perforation system cut away to reveal a downward fluid flow path according to an embodiment.

FIG. 2 is an enlarged elevation view in partial axial cross section of the perforation system 100 of FIG. 1. In one or more embodiments, perforating gun 120 may assembled in a hollow steel carrier 212 made from a length of straight wall tubing, preferably high strength steel. Hollow steel carrier 212 may have gun ports, or thinned wall areas often referred to as scallops, 220 aligned with shaped charges (not illustrated) supported within carrier 212. A charge holder (not illustrated) provides a frame for assembling the shaped charges and connecting them with a detonating system.

In one or more embodiments, the shaped charges and scallops 220 may be arranged in a linear configuration along a single side of perforating gun 120 so as face in only a single radial direction. In one or more alternative embodiments, the shaped charges and scallops 220 may be arranged about the radius of carrier 212, such as in a helical or other configuration. The shaped charges may be selectively and individually detonatable, so that only those shaped charges facing in a single select radial direction may be detonated if desired. In yet one or more embodiments, perforating gun 120 may include multiple groupings 122 of shaped charges and scallops 220, wherein each grouping 112 may be selectively and individually detonatable. However, perforating gun 120 described herein is not limited to a particular type of arrangement, and that the forgoing general components are provided for illustrative purposes only.

FIG. 2 illustrates a portion of working string 22, packer 110, perforating gun 120, upper and lower bridge subs 130, 140, and discharge flow port 150 cut away to reveal a downward fluid flow path, shown by arrows 102, according to an embodiment. Working string 22 defines hollow interior 23. Working string may carry packer 110 above perforating gun 120. Packer 110 may include a sealing element 112, which be selectively expandable, for example by hydraulic or mechanical actuation, so as to force sealing element 112 into sealing engagement against the interior wall of casing 16. Packer 110 may include an internal flow path 114 that is in fluid communication with interior 23 of working string 22.

In one or more embodiments, upper and lower bridge subs 130, 140 are carried along working string 22 and are located above and below, respectively, perforating gun 120. Upper and lower bridge subs 130, 140 are hollow and each have an open end and a closed end. The closed ends of upper and lower bridge subs 130, 140 are mechanically connected to perforating gun 120. The open end of upper bridge sub 130 is mechanically connected to working string 22 and is in fluid communication with interior 23 of working string 22. Similarly, the open end of lower bridge sub 140 is mechanically connected to and in fluid communication with discharge flow port 150.

Upper bridge sub 130 may be fluidly coupled to lower bridge sub 140 by one or more exterior conduits 160, which may connect between radial ports formed upper and lower bridge subs 130, 140 and pass longitudinally along an exterior surface of perforating gun 120. In some embodiments, multiple exterior conduits 160 are provided to accommodate required treatment flow rates. Such multiple exterior conduits 160 may be distributed about the circumference of perforating gun 120 so as not to interfere with the shaped charges and scallops 220.

Figure 3:
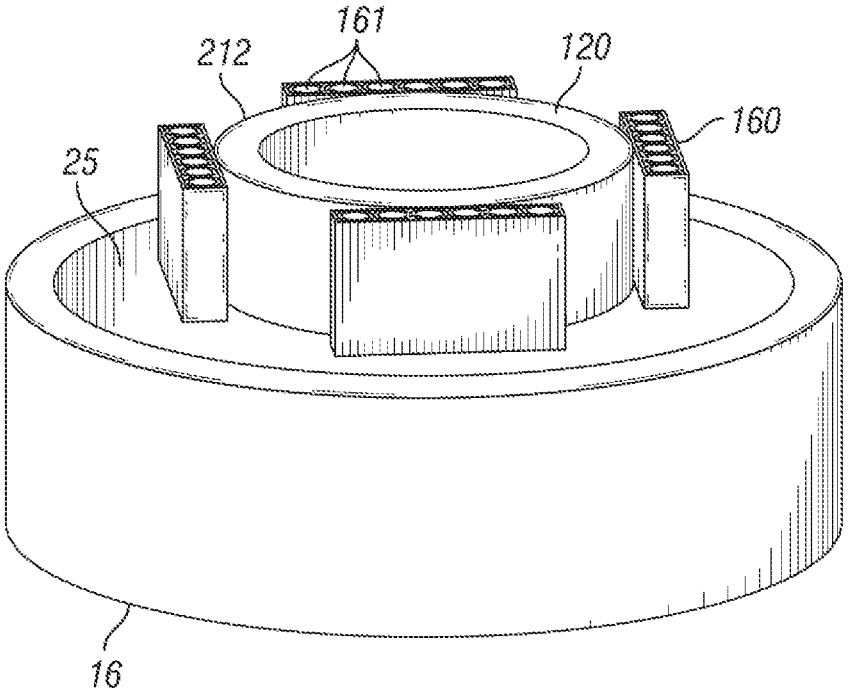
FIG. 3 is an enlarged perspective view in transverse cross section of a portion of the perforation system of FIG. 1, showing a circumferential arrangement of exterior conduits intervaled about the outer circumference of the perforating gun.

As illustrated in FIG. 3, in one or more embodiments, each exterior conduit 160 may include a parallel arrangement of discrete tubes 161, which may collectively be referred to as a flat pack and which provides a fluidic link between upper and lower bridge subs 130, 140 (FIG. 2). The discrete tubes 161 may be conjoined to form a unitary structure. A flat pack may be available in a variety of configurations to suit a particular application and well environment. The specification and materials may be selected based well temperature, pressure, and fluid composition. Single or multiple flat pack configurations may be available. In one or more embodiments, a flat pack includes ½ inch tubes. Although four flat pack exterior conduits 160, each having six discrete tubes 161, are illustrated, the number and sizing of exterior conduits 160 may vary and be determined to provide adequate flow rate with minimal pressure loss while considering the effects on annular area, friction, and fluid velocity within annulus 25, as described in greater detail hereinafter.

Referring back to FIG. 2, according to one or more embodiments, upper and lower bridge subs 130, 140 function as manifolds, with upper bridge sub 130 distributing treatment fluid from working string 22 into exterior conduits 160, and lower bridge sub 140 recombining flow from exterior conduits 160 into discharge flow port 150. Discharge flow port 150 may be arranged to radially dispense treatment fluid into wellbore 12 below perforating gun 120 in a manner to effectively displace heavier density completion fluid in wellbore annulus 25 to a level above the zone of interest to be perforated. Discharge flow ports 150 having various configurations for fluid displacement operations may be commercially available.

In this manner, perforation system 100 may allow the operator to run the system in the well and displace completion fluid within the zone of interest by formation-compatible treatment fluid without running a separate displacement string or providing additional rat hole length. That is, perforation system 100 is a single trip system that may save rig time and reduce risk of multiple control lines passing through various well restrictions. Perforation system 100 may be suitable for overbalanced and underbalanced operations and use within fluid sensitive formations.

The procedure for effectively displacing a completion fluid by a formation-safe treatment fluid may involve chemical, mechanical, and hydraulic considerations, which may be well-specific. Improperly displaced wellbores may leave behind unwanted fluid in front of the perforations, which may negatively affect production results. Factors to be considered may include fluid types, pressure constraints, environmental discharge limitations, and time constraints due to rig operations or cost.

Displacement fluids may be engineered for each application for thorough removal of unwanted fluids. The chemical components of the treatment fluid may encompass a wide range of acids, well cleaners, viscosifiers, solids-free fluids, high-performance environmentally compliant wash pills, and spacers formulated with combined chemistry and engineering technologies to efficiently displace the unwanted completion fluid. Displacement fluids may be designed to overcome temperature- and pressure-related challenges while maintaining compatibility with formation 20 and other fluid systems.

Discharge flow port 150 may be selected for a particular wellbore 12 to provide a desired hydrodynamic performance for efficient fluid displacement. For example, effective displacement of completion fluid within annulus 25 may depend in part on the treatment fluid velocity within annulus 25, and as casing diameter is reduced with well depth, the annular area decreases resulting in increased velocity for a given mass flow rate, increased back pressure, and high friction. Displacement effectiveness may also depend the nature of treatment fluid flow. Turbulent flow may provide better displacement than a laminar flow, for example. Perforation system 100 may be engineered so that the performance of discharge flow port 150 continues to provide the desired hydrodynamic performance for efficient fluid displacement even with perforation gun 120 positioned between working string 22 and discharge flow port 150.

Accordingly, in a preferred embodiment, upper and lower bridge subs 130, 140, the number and sizing of exterior conduits 160, and discharge flow port 150 are designed in conjunction with a complete wellbore hydraulics analysis to build a displacement strategy for the particular wellbore 12. Treatment fluid flow rate may be determined allowing for working string eccentricity and taking into consideration working string inner diameter, length, roughness, treatment fluid viscosity and density, and completion fluid density to provide desired annular velocity, pressure losses, and hydrostatic pressure. In one or more embodiments, mathematical simulations may be used calculate critical displacement and evaluation parameters for downhole fluid dynamics inclusive of fluid velocities within the engineered flow and displacement path.

For example, the Darcy-Weisbach Equation, Equation 1, may be used calculate differential pressure across working string 22 and exterior conduits 160 at injection depth:

$$\Delta p = \lambda\left(\frac{l}{d_h}\right)\frac{\rho v^2}{2} \qquad \text{Eq. 1}$$

where $\Delta p$ is the differential pressure at injection depth, $\lambda$ is the dimensionless Darcy friction factor, $d_h$ is the hydraulic diameter of exterior conduits 160, $\rho$ is the injection fluid density, and v is the injection fluid viscosity.

The Darcy friction factor, $\lambda$, may vary based on whether the flow is laminar (e.g., low Reynolds number Re), transitional (e.g., intermediate Re), or turbulent (e.g., high Re). The Reynolds number Re is a dimensionless ratio of inertial forces to viscous forces that may be used to characterize flow regimes. For turbulent flow, the Darcy friction factor, $\lambda$, may be calculated from the Colebrook Equation:

$$\frac{1}{\sqrt{\lambda}} = -2\log_{10}\left(\frac{2.51}{\mathrm{Re}\sqrt{\lambda}} + \frac{k}{3.72d_h}\right) \qquad \text{Eq. 2}$$

where k is the pipe roughness length.

From the differential pressure at injection depth, $\Delta p$, the required minimum pump pressure may be determined. Additionally, the pump rate to achieve a given fluid flow velocity may be determined.

Figure 4:
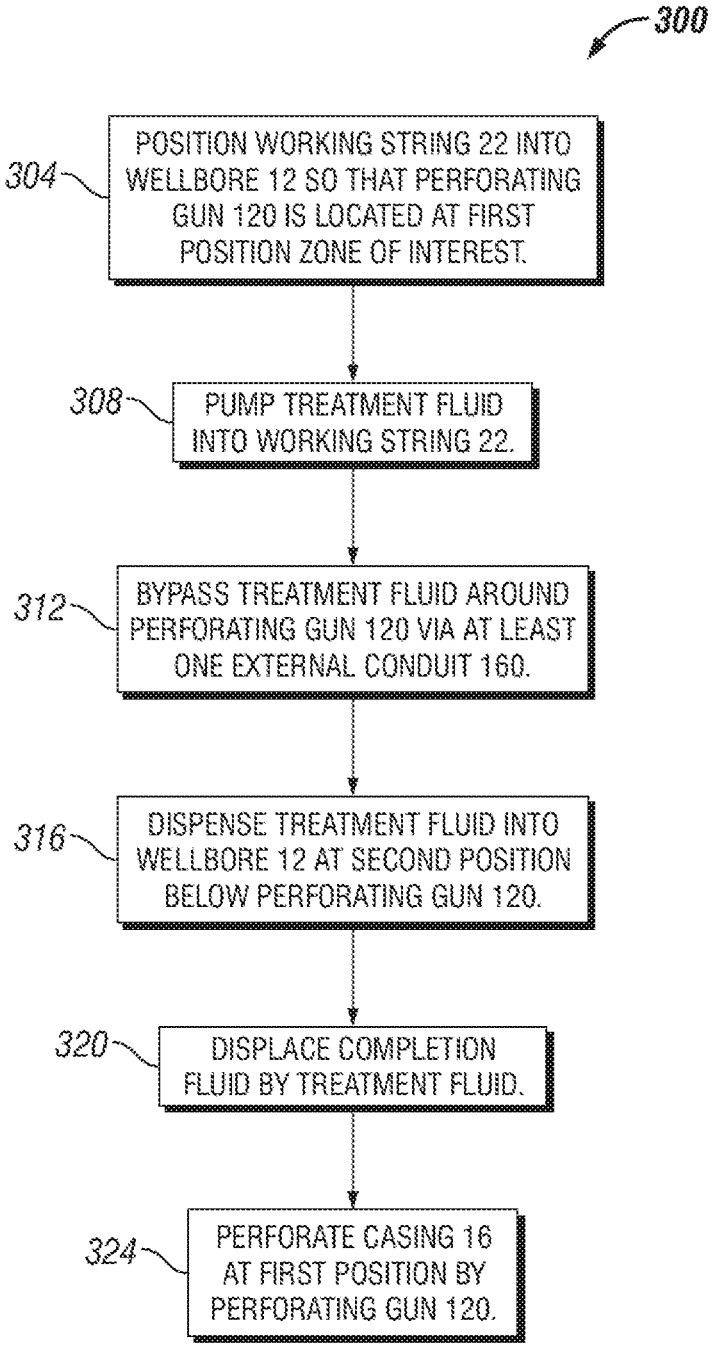
FIG. 4 is a flowchart of a method for perforating a wellbore casing according to an embodiment.

FIG. 4 is a flow chart of a method 300 according to one or more embodiments for dispensing treatment fluid into wellbore 12 below perforating gun 120 in a manner to effective displace heavier density completion fluid in wellbore annulus 25 to a level above the zone of interest to be perforated and then perforating the casing at the zone of interest in a single trip, without the need for repositioning working string 22 or for providing an extended rat hole below the zone of interest to accommodate the fluid displacement components.

Referring now to FIGS. 2 and 4, prior to performing method 300, wellbore 12 may be filled with a completion fluid left over from pervious operations. At step 304, working string 22 with perforating gun 120 may be conventionally run into a wellbore 12. Working string 22 may be positioned so that perforating gun 120 is located at a first position—the zone of interest to be perforated—within casing 16.

At steps 308, 312, and 316, a treatment fluid may be pumped through working string 22, bypassing perforating gun 120 via at least exterior conduit 160 disposed along the exterior surface of perforating gun 120 and dispensed into wellbore at second position below perforating gun 120 and the zone of interest. The treatment fluid may be a lighter density formation-compatible fluid, as described above.

More particularly, treatment fluid may be bypassed around the exterior of perforating gun 120 by flowing the treatment fluid into upper bridge sub 130 above perforating gun 120, which distributes the fluid into one or more exterior conduits 160, which in turn delivers the treatment fluid to lower bridge sub 140 below perforating gun 120 for recombination and mixing. Treatment fluid may enter discharge flow port 150 in a flow regime similar to that if upper and lower bridge subs 130, 140 and conduit(s) 160 were not present, thereby allowing for effective fluid displacement.

At step 320, treatment fluid may be pump into wellbore 12 until the completion fluid has been displaced to a level higher than the zone of interest, thereby allowing perforation of casing 16 at the zone of interest with reduced risk of formation damage and without the need to provide an extended rat hole, reposition working string 22, or make a separate trip with a dedicated fluid displacement system.

In summary, systems and methods for perforating a wellbore casing have been described. Embodiments of a system for perforating a wellbore may generally have: A working string having a hollow interior; a perforating gun carried along the working string; an upper bridge sub disposed along the working string above the perforating gun and fluidly coupled to the interior of the working string; a lower bridge sub disposed along the working string below the perforating gun and fluidly coupled to a discharge flow port; and at least one exterior conduit fluidly coupled between the upper and lower bridge subs and disposed along an exterior surface of the perforating gun. Embodiments of a method for perforating a wellbore may generally include: Positioning a working string into a cased wellbore so that a perforating gun carried along the working string is located at a first position within the wellbore; pumping a treatment fluid through the working string; bypassing the treatment fluid around the perforating gun via at least one conduit disposed along an exterior of the perforating gun; dispensing the treatment fluid into the wellbore at a second position below the perforating gun; displacing a completion fluid in the wellbore with the treatment fluid; and then perforating the casing at the first position with the perforating gun. Embodiments of a method for perforating a wellbore may also generally include: Selecting a discharge flow port that is dimensioned to provide a desired controlled flow characteristic for displacing a heavier fluid uphole in a wellbore by a lighter displacement fluid when the discharge flow port is connected directly to a distal end of a working string; connecting a perforating gun between an upper bridge sub and a lower bridge sub; connecting the upper bridge sub to the distal end of the working string; connecting the discharge flow port to the lower bridge sub; fluidly coupling the upper bridge sub to the lower bridge sub by at least one conduit disposed long an exterior surface of the perforating gun, the upper bridge sub, the lower bridge sub, and the at least one conduit being dimensioned to provide the desired controlled flow characteristic by the discharge flow port; positioning the working string into a cased wellbore so that the perforating gun is located at a first position within the wellbore; pumping a treatment fluid through the discharge flow port to displace a completion fluid to a level above the perforating gun; and then perforating the casing at the first position with the perforating gun.

Any of the foregoing embodiments may include any one of the following elements or characteristics, alone or in combination with each other: A packer carried along the working string above the upper bridge sub; a plurality of exterior conduits fluidly coupled between the upper and lower bridge subs and disposed along an exterior surface of the perforating gun; the at least one exterior conduit includes a plurality of conjoined parallel tubes; a first radial port formed in the upper bridge sub; a second radial port formed in the lower bridge sub, the at least one exterior conduit connected between the first and second radial ports; pumping the treatment fluid into an upper bridge sub located above the perforating gun; pumping the treatment fluid into the at least one conduit from the upper bridge sub; pumping the treatment fluid into a lower bridge sub located below the perforating gun from at least the one conduit; fluidly coupling the upper bridge sub with the lower bridge sub by a plurality of conduits disposed along an exterior surface of the perforating gun; the plurality of conduits includes a plurality of conjoined parallel tubes; setting a packer at a third position above the perforating gun after displacing the completion fluid and before perforating the casing; the treatment fluid is characterized by a lower density than the completion fluid; displacing the completion fluid in the wellbore by the treatment fluid to a level higher than the first position; pumping the treatment fluid through the discharge flow port via the working string, the upper bridge sub, the at least one conduit, and the lower bridge sub; the at least one conduit include a plurality of conjoined parallel tubes; and setting a packer at a position above the perforating gun after displacing the completion fluid and before perforating the casing.

The Abstract of the disclosure is solely for providing the reader a way to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method for perforating a wellbore casing, comprising:

positioning a working string into a wellbore cased with said casing to define an annulus around said working string between said working string and said casing and so that a perforating gun carried along said working string is located within a completion fluid in said annulus at a first position within said wellbore;

determining a pump rate sufficient to achieve a flow velocity for generating turbulent flow in a treatment fluid within said annulus around said working string in said wellbore;

pumping said treatment fluid through said working string at or above the pump rate;

bypassing said treatment fluid around said perforating gun via at least one conduit including a plurality of conjoined parallel tubes disposed along an exterior of said perforating gun, the plurality of conjoined parallel tubes arranged as a flat pack with each conjoined tube circumferentially spaced from other conjoined tubes and arranged in a single row around said exterior surface of said perforating gun;

discharging said treatment fluid from said working string to generate turbulent flow characteristics in said treatment fluid in said annulus said at a second position below said perforating gun;

displacing said completion fluid in said annulus away from said perforating gun with said turbulent flow characteristics in said treatment fluid in said annulus; and then perforating said casing at said first position with said perforating gun.

2. The method of claim 1 further comprising:

pumping said treatment fluid into an upper bridge sub located above said perforating gun;

pumping said treatment fluid into said at least one conduit from said upper bridge sub; and pumping said treatment fluid into a lower bridge sub located below said perforating gun from at least said one conduit.

3. The method of claim 2 further comprising:

fluidly coupling said upper bridge sub with said lower bridge sub by a plurality of conduits disposed along an exterior surface of said perforating gun, wherein each conduit of the plurality of conduits includes a plurality of said conjoined parallel tubes.

4. The method of claim 3 wherein:

said plurality of conduits includes at least four conduits arranged around said exterior surface of said perforating gun.

5. The method of claim 1 further comprising:

setting a packer at a third position above said perforating gun after displacing said completion fluid and before perforating said casing.

6. The method of claim 1 wherein:

said treatment fluid is characterized by a lower density than said completion fluid.

7. The method of claim 1 further comprising:

displacing said completion fluid in said wellbore by said treatment fluid to a level higher than said first position.

8. The method of claim 1 wherein perforating said casing includes perforating said casing in an overbalanced pressure condition.

9. The method of claim 1, wherein once said perforating gun is positioned at said first position, the perforating gun is maintained at said first position without repositioning during pumping said treatment fluid, bypassing said treatment fluid, discharging said treatment fluid, displacing said completion fluid and until perforating said casing is complete.

10. A system for perforating a wellbore casing, comprising:

a working string having a hollow interior;

a perforating gun carried along said working string;

an upper bridge sub disposed along said working string above said perforating gun and fluidly coupled to said interior of said working string;

a lower bridge sub disposed along said working string below said perforating gun;

a discharge flow port along said working string below said perforating gun;

at least one exterior conduit fluidly coupled between said upper and lower bridge subs and disposed along an exterior surface of said perforating gun, the at least one exterior conduit including a plurality of conjoined parallel tubes arranged as a flat pack with each conjoined tube circumferentially spaced from other conjoined tubes an arranged in a single row around said exterior surface of said perforating gun; and a pump operable to pressurize a treatment fluid in said working string to flow through said upper bridge sub, said at least one exterior conduit and said lower bridge sub, and discharge said treatment fluid through said discharge flow port.

11. The system of claim 10 further comprising:

a packer carried along said working string above said upper bridge sub.

12. The system of claim 10 further comprising:

a plurality of exterior conduits fluidly coupled between said upper and lower bridge subs and disposed along an exterior surface of said perforating gun.

13. The system of claim 10, further comprising:

a first radial port formed in said upper bridge sub; and a second radial port formed in said lower bridge sub, said at least one exterior conduit connected between said first and second radial ports.

14. The system of claim 10 wherein said discharge flow port is arranged radially with respect to said working string.

15. The system of claim 10, wherein the at least one exterior conduit passes longitudinally along said exterior surface of said perforating gun.

16. A method for perforating a wellbore casing, comprising:

selecting a discharge flow port that is dimensioned to provide a desired controlled flow characteristic for displacing a heavier fluid uphole in a wellbore by a lighter displacement fluid when said discharge flow port is connected directly to a distal end of a working string;

connecting a perforating gun between an upper bridge sub and a lower bridge sub;

connecting said upper bridge sub to said distal end of said working string;

connecting said discharge flow port to said lower bridge sub;

fluidly coupling said upper bridge sub to said lower bridge sub by at least one conduit disposed long an exterior surface of said perforating gun, said at least one conduit including a plurality of conjoined parallel tubes arranged as a flat pack with each conjoined tube circumferentially spaced from other conjoined tubes and arranged in a single row around said exterior surface of said perforating gun, said upper bridge sub, said lower bridge sub, and said at least one conduit being dimensioned to provide said desired controlled flow characteristic by said discharge flow port;

positioning said working string into a cased wellbore so that said perforating gun is located at a first position within said wellbore in an annulus defined around said working string between said working string and said casing;

pumping a treatment fluid through said working string at a sufficient at a sufficient pump rate determined to generate turbulent flow characteristics in said treatment fluid upon discharge from said working string into said annulus;

discharging said treatment fluid from said working string through said discharge flow port below said perforating gun to generate turbulent flow characteristics in said treatment fluid in said annulus around said working string below said perforating gun to thereby displace a completion fluid to a level above said perforating gun with said turbulent flow characteristics in said treatment fluid; and then perforating said casing at said first position with said perforating gun.

17. The method of claim 16, further comprising:

pumping said treatment fluid through said discharge flow port via said working string, said upper bridge sub, said at least one conduit, and said lower bridge sub.

18. The method of claim 16 further comprising:

setting a packer at a position above said perforating gun after displacing said completion fluid and before perforating said casing.

19. The method of claim 16 wherein:

said treatment fluid is characterized by a lower density than said completion fluid.

* * * * *